US006379522B1

(12) United States Patent
Landau et al.

(10) Patent No.: US 6,379,522 B1
(45) **Date of Patent: *Apr. 30, 2002**

(54) ELECTRODEPOSITION CHEMISTRY FOR FILLING OF APERTURES WITH REFLECTIVE METAL

(75) Inventors: Uziel Landau, Cleveland; John J. D'Urso, Niles, both of OH (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/227,957

(22) Filed: Jan. 11, 1999

(51) Int. Cl.[7] ..... C25D 3/38

(52) U.S. Cl. ..... 205/157; 205/123; 205/261; 205/298

(58) Field of Search ..... 205/123, 157, 205/261, 296, 297, 298

(56) References Cited

U.S. PATENT DOCUMENTS

| | | | | |
|---|---|---|---|---|
| 3,161,575 A | | 12/1964 | Wells et al. | 204/52 |
| 3,727,620 A | | 4/1973 | Orr | 134/95 |
| 3,770,598 A | | 11/1973 | Creutz | 204/52 R |
| 4,009,087 A | * | 2/1977 | Kardos et al. | 205/298 |
| 4,027,686 A | | 6/1977 | Shortes et al. | 134/33 |
| 4,092,176 A | | 5/1978 | Kozai et al. | 134/186 |
| 4,110,176 A | | 8/1978 | Creutz et al. | 204/52 R |
| 4,113,492 A | | 9/1978 | Sato et al. | 96/67 |
| 4,272,335 A | * | 6/1981 | Combs | 205/298 |
| 4,315,059 A | | 2/1982 | Raistrick et al. | 429/112 |
| 4,336,114 A | | 6/1982 | Mayer et al. | 204/52 |
| 4,376,685 A | | 3/1983 | Watson | 204/52 R |
| 4,405,416 A | | 9/1983 | Raistrick et al. | 204/68 |
| 4,489,740 A | | 12/1984 | Rattan et al. | 134/140 |
| 4,510,176 A | | 4/1985 | Cuthbert et al. | 427/82 |
| 4,518,678 A | | 5/1985 | Allen | 430/311 |
| 4,519,846 A | | 5/1985 | Aigo | 134/15 |
| 4,693,805 A | | 9/1987 | Quazi | 204/192.22 |
| 4,732,785 A | | 3/1988 | Brewer | 427/240 |
| 5,039,381 A | | 8/1991 | Mullarkey | 204/47.5 |
| 5,055,425 A | | 10/1991 | Leibovitz et al. | 437/195 |
| 5,155,336 A | | 10/1992 | Gronet et al. | 219/411 |
| 5,162,260 A | | 11/1992 | Leibovitz et al. | 437/195 |
| 5,222,310 A | | 6/1993 | Thompson et al. | 34/202 |
| 5,224,504 A | | 7/1993 | Thompson et al. | 134/155 |
| 5,230,743 A | | 7/1993 | Thompson et al. | 134/32 |
| 5,252,807 A | | 10/1993 | Chizinsky | 219/390 |
| 5,256,274 A | | 10/1993 | Poris | 205/123 |
| 5,259,407 A | | 11/1993 | Tuchida et al. | 134/151 |
| 5,290,361 A | | 3/1994 | Hayashida et al. | 134/2 |
| 5,316,974 A | | 5/1994 | Crank | 437/190 |
| 5,328,589 A | | 7/1994 | Martin | 205/296 |
| 5,349,978 A | | 9/1994 | Sago et al. | 134/153 |
| 5,368,711 A | | 11/1994 | Poris | 204/193 |
| 5,377,708 A | | 1/1995 | Bergman et al. | 134/105 |
| 5,429,733 A | | 7/1995 | Ishida | 204/224 R |
| 5,608,943 A | | 3/1997 | Konishi et al. | 15/302 |
| 5,625,170 A | | 4/1997 | Poris | 177/50 |
| 5,651,865 A | | 7/1997 | Sellers | 204/192.13 |
| 5,705,223 A | | 1/1998 | Bunkofske | 427/240 |
| 5,718,813 A | | 2/1998 | Drummond et al. | 204/192.12 |
| 5,723,028 A | | 3/1998 | Poris | 204/231 |

FOREIGN PATENT DOCUMENTS

| | | |
|---|---|---|
| EP | 0163131 A2 | 12/1985 |
| EP | 0952242 A1 | 10/1999 |
| JP | 60056086 | 4/1985 |

OTHER PUBLICATIONS

Peter Singer, "Wafer Processing," 70/Semiconductor International, Jun. 1998, 1 page.

Lucio Colombo, "Wafer Back Surface Film Removal," Central R&D, SGS–Thompson, Microelectronics, Agrate, Italy, 6 pages, No date available.

Semitool©, Inc., "Metallization & Interconnect," 1998, 4 pages, Month of publication not available.

Verteq Online©, "Products Overview," 1996–1998, 5 pages, Month of publication not available.

"Copper Deposition in the Presence of Polyethylene Glycol", Kelly, et al., J. Electrochem. Soc., vol. 145, No. 10, Oct. 1998, pp. 3472–3476.

PCT International Search Report dated Oct. 11, 2000.

Laurell Technologies Corporation, "Two control configurations available–see WS 400 OR WS–400Lite." Oct. 19, 1998, 6 pages.

Peter Singer, "Tantalum, Copper and Damascene: The Future of Interconnects," Semiconductor International, Jun., 1998, Pages cover, 91–92,94,96 & 98.

Peter Singer, "Wafer Processing," Semiconductor International, Jun., 1998, p. 70.

* cited by examiner

*Primary Examiner*—Donald R. Valentine
*Assistant Examiner*—William T. Leader
(74) *Attorney, Agent, or Firm*—Moser, Patterson & Sheridan, LLP

(57) ABSTRACT

The present invention provides plating solutions, particularly metal plating solutions, designed to provide uniform coatings on substrates and to provide substantially defect free filling of small features formed on substrates with none or low supporting electrolyte, i.e., which include no acid, low acid, no base, or no conducting salts, and/or high metal ion, e.g., copper, concentration. Defect free filling of features is enhanced by a plating solution containing blends of polyalkylene glycols ("carrier") and organic divalent sulfur compounds ("accelerator"), wherein the concentration of the carrier ranges from about 10 ppm to about 2000 ppm of the plating solution, and the concentration of the accelerator ranges from about 0.1 ppm to about 1000 ppm of the plating solution. The plating solution may be further improved by adding 2-amino-5-methyl-1,3,4-thiadiazole which is used at concentrations from 0 ppm to about 20 ppm of the plating solution.

18 Claims, No Drawings

ELECTRODEPOSITION CHEMISTRY FOR FILLING OF APERTURES WITH REFLECTIVE METAL

BACKGROUND OF THE INVENTION

1. Field of the Invention

The present invention relates to new formulations of metal plating solutions designed to provide uniform coatings on substrates and to provide defect free filling of small features, e.g., micron scale features and smaller, formed on substrates with reflective metals.

2. Background of the Related Art

Electrodeposition of metals has recently been identified as a promising deposition technique in the manufacture of integrated circuits and flat panel displays. As a result, much effort is being focused in this area to design hardware and chemistry to achieve high quality films on substrates which are uniform across the area of the substrate and which can fill or conform to very small features.

Typically, the chemistry, i.e., the chemical formulations and conditions, used in conventional plating cells is designed to provide acceptable plating results when used in many different cell designs, on different plated parts and in numerous different applications. Cells which are not specifically designed to provide highly uniform current density (and the deposit thickness distribution) on specific plated parts require high conductivity solutions to be utilized to provide high 'throwing power' (also referred to as high Wagner number) so that good coverage is achieved on all surfaces of the plated object. Typically, a supporting electrolyte, such as an acid or a base, or occasionally a conducting salt, is added to the plating solution to provide the high ionic conductivity to the plating solution necessary to achieve high 'throwing power'. The supporting electrolyte does not participate in the electrode reactions, but is required in order to provide conformal coverage of the plated material over the surface of the object because it reduces the resistivity within the electrolyte, the higher resistivity that otherwise occurs being the cause of the non-uniformity in the current density. Even the addition of a small amount, e.g., 0.2 Molar, of an acid or a base will typically increase the electrolyte conductivity quite significantly (e.g., almost double the conductivity).

However, on objects such as semiconductor substrates that are resistive, e.g., metal seeded wafers, high conductivity of the plating solution negatively affects the uniformity of the deposited film. This is commonly referred to as the terminal effect and is described in a paper by Oscar Lanzi and Uziel Landau, "Terminal Effect at a Resistive Electrode Under Tafel Kinetics", J. Electrochem. Soc. Vol. 137, No. 4 pp. 1139–1143, April 1990, which is incorporated herein by reference. This effect is due to the fact that the current is fed from contacts along the circumference of the part and must distribute itself across a resistive substrate. If the electrolyte conductivity is high, such as in the case where excess supporting electrolyte is present, it will be preferential for the current to pass into the solution within a narrow region close to the contact points rather than distribute itself evenly across the resistive surface, i.e., it will follow the most conductive path from terminal to solution. As a result, the deposit will be thicker close to the contact points. Therefore, a uniform deposition profile over the surface area of a resistive substrate is difficult to achieve.

Another problem encountered with conventional plating solutions is that the deposition process on small features is controlled by mass transport (diffusion) of the reactants to the feature and by the kinetics of the electrolytic reaction instead of by the magnitude of the electric field as is common on large features. In other words, the replenishment rate at which plating ions are provided to the surface of the object can limit the plating rate, irrespective of voltage. Essentially, if the voltage dictates a plating rate that exceeds the local ion replenishment rate, the replenishment rate dictates the plating rate. Hence, highly conductive electrolyte solutions that provide conventional "throwing power" have little significance in obtaining good coverage and fill within very small features. In order to obtain good quality deposition, one must have high mass-transport rates and low depletion of the reactant concentration near or within the small features. However, in the presence of excess acid or base supporting electrolyte, (even a relatively small excess) the transport rates are diminished by approximately one half (or the concentration depletion is about doubled for the same current density). This will cause a reduction in the quality of the deposit and may lead to fill defects, particularly on small features.

It has been learned that diffusion is of significant importance in conformal plating and filling of small features. Diffusion of the metal ion to be plated is directly related to the concentration of the plated metal ion in the solution. A higher metal ion concentration results in a higher rate of diffusion of the metal into small features and in a higher metal ion concentration within the depletion layer (boundary layer) at the cathode surface, hence faster and better quality deposition may be achieved. In conventional plating applications, the maximum concentration of the metal ion achievable is typically limited by the solubility of its salt. If the supporting electrolyte, e.g., acid, base, or salt, contain a co-ion which provides a limited solubility product with the plated metal ion, the addition of a supporting electrolyte will limit the maximum achievable concentration of the metal ion. This phenomenon is called the common ion effect. For example, in copper plating applications, when it is desired to keep the concentration of copper ions very high, the addition of sulfuric acid will actually diminish the maximum possible concentration of copper ions. The common ion effect essentially requires that in a concentrated copper sulfate electrolyte, as the sulfuric acid ($H_2SO_4$) concentration increases (which gives rise to $H^+$ cations and $HSO_4^-$ and $SO_4^-$ anions), the concentration of the copper (I) cations decreases due to the greater concentration of the other anions. Consequently, conventional plating solutions, which typically contain excess sulfuric acid, are limited in their maximal copper concentration and, hence, their ability to fill small features at high rates and without defects is limited.

Therefore, there is a need for new formulations of metal plating solutions designed particularly to provide good quality plating of small features, e.g., micron scale and smaller features, on substrates and to provide uniform coating and defect-free fill of such small features.

SUMMARY OF THE INVENTION

The present invention provides plating solutions having novel blends of specific additives that enhance defect-free fill of small features. The plating solutions promote uniform metal deposition within the features and can provide highly reflective metal surfaces without polishing. The plating solutions typically contain little or no supporting electrolyte (i.e., which include no acid, low acid, no base, or no conducting salts) and/or high metal ion concentration (e.g., copper). The additives that enhance uniform deposition include blends of polyalkylene glycol ("carrier") and organic divalent sulfur compounds ("accelerator"), wherein the concentration of the carrier ranges from about 10 ppm to about 2000 ppm of the plating solution, and the concentration of the accelerator ranges from about 0.1 ppm to about 1000 ppm of the plating solution. Additionally, the plating solutions may contain additives which enhance the plated film quality and performance by serving, inter alia, as brighteners, levelers, surfactants, grain refiners, and stress reducers. A preferred example for an additive that enhances brightness of plated copper is 2-amino-5-methyl-1,3,4-thiadiazole which is used at concentrations from 0 ppm to about 20 ppm of the plating solution.

DETAILED DESCRIPTION OF A PREFERRED EMBODIMENT

The present invention generally relates to electroplating solutions having low conductivity, particularly those solutions containing no supporting electrolyte or low concentration of supporting electrolyte, i.e., essentially no acid or low acid (and where applicable, no or low base) concentration, essentially no conducting salts and high metal concentration to achieve good deposit uniformity across a resistive substrate and to provide good fill within very small features such as micron and sub-micron sized features and smaller. The invention provides plating solutions having high concentrations of metal ions and low concentrations of a blend of additives that provide uniform plating of the metal ions to provide even deposition within small features. The blend of additives include blends of polyalkylene glycols ("carrier") and organic divalent sulfur compounds ("accelerator"). The concentration of the carrier ranges from about 10 ppm to about 2000 ppm of the plating solution, preferably from about 50 ppm to about 200 ppm of the plating solution. The concentration of the accelerator ranges from about 0.1 ppm to about 1000 ppm of the plating solution, preferably from about 1 ppm to about 40 ppm of the plating solution. Other additives are included, and typically improve brightening and other properties of the resultant metal plated on substrates when used in electroplating solutions with no or low supporting electrolyte, e.g., no or low acid. A preferred brightening agent is 2-amino-5-methyl-1,3,4-thiadiazole which is used at concentrations from 0 ppm to about 20 ppm of the plating solution, preferably from about 0.5 ppm to about 5 ppm of the plating solution. The invention is described below in reference to plating of copper on substrates in the electronic industry. However, it is to be understood that the electroplating solutions, particularly those having low or complete absence of supporting electrolyte, can be used to deposit other metals on resistive substrates and has application in any field where plating can be used to advantage.

In one embodiment of the invention, aqueous copper plating solutions are employed which are comprised of copper sulfate, preferably from about 200 to about 350 grams per liter (g/l) of copper sulfate pentahydrate in water ($H_2O$), and essentially no added sulfuric acid. The copper concentration may be from about 0.2 to about 1.2 Molar, and is preferably greater than about 0.4 Molar. In addition to copper sulfate, the invention contemplates copper salts other than copper sulfate, such as copper fluoborate, copper gluconate, copper sulfamate, copper sulfonate, copper pyrophosphate, copper chloride, copper cyanide and the like, all without (or with little) supporting electrolyte. Some of these copper salts offer higher solubility than copper sulfate, and therefore may be advantageous.

The conventional copper plating electrolyte includes a relatively high sulfuric acid concentration (from about 45 g of $H_2SO_4$ per L of $H_2O$(0.45M) to about 110 g/L (1.12M)) which is provided to the solution to provide high conductivity to the electrolyte. The high conductivity is necessary to reduce the non-uniformity in the deposit thickness caused by the cell configuration and the differently shaped parts encountered in conventional electroplating cells. However, the present invention is directed primarily towards applications where the cell configuration has been specifically designed to provide a relatively uniform deposit thickness distribution on given parts. However, the substrate is resistive and imparts thickness non-uniformity to the deposited layer. Thus, among the causes of non-uniform plating, the resistive substrate effect may dominate and a highly conductive electrolyte, containing, e.g., high $H_2SO_4$ concentrations, is unnecessary. In fact, a highly conductive electrolyte (e.g., generated by a high sulfuric acid concentration) is detrimental to uniform plating because the resistive substrate effects are amplified by a highly conductive electrolyte. This is the consequence of the fact that the degree of uniformity of the current adistribution, and the corresponding deposit thickness, is dependent on the ratio of the resistance to current flow within the electrolyte to the resistance of the substrate. The higher this ratio is, the lesser is the terminal effect and the more uniform is the deposit thickness distribution. Therefore, when uniformity is a primary concern, it is desirable to have a high resistance within the electrolyte. Since the electrolyte resistance is given by $1/\kappa\pi r^2$, it is advantageous to have as low a conductivity, $\kappa$, as possible, and also a large gap, 1, between the anode and the cathode. Also, clearly, as the substrate radius, r, becomes larger, such as when scaling up from 200 mm wafers to 300 mm wafers, the terminal effect will be much more severe (e.g., by a factor of 2.25). By eliminating the acid, the conductivity of the copper plating electrolyte typically drops from about 0.5 S/cm (0.5 $ohm^{-1}cm^{-1}$) to about 1/10 of this value, i.e., to about 0.05 S/cm, making the electrolyte ten times more resistive.

Also, a lower supporting electrolyte concentration (e.g., sulfuric acid concentration in copper plating) often permits the use of a higher metal ion (e.g., copper sulfate) concentration due to elimination of the common ion effect as explained above. Furthermore, in systems where a soluble copper anode is used, a lower added acid concentration (or preferably no acid added at all) minimizes harmful corrosion and material stability problems. Additionally, a pure or relatively pure copper anode can be used in this arrangement. Because some copper dissolution typically occurs in an acidic environment, copper anodes that are being used in conventional copper plating typically contain phosphorous. The phosphorous forms a film on the anode that protects it from excessive dissolution, but phosphorous traces will be found in the plating solution and also may be incorporated as a contaminant in the deposit. In applications using plating solutions with no acidic supporting electrolytes as described herein, the phosphorous content in the anode may, if needed, be reduced or eliminated. Also, for environmental considerations and ease of handling the solution, a non acidic electrolyte is preferred.

Another method for enhancing thickness uniformity includes applying a periodic current reversal. For this reversal process, it may be advantageous to have a more resistive solution (i.e., no supporting electrolyte) since this serves to focus the dissolution current at the extended features that one would want to preferentially dissolve.

In some specific applications, it may be beneficial to introduce small amounts of acid, base or salts into the plating solution. Examples of such benefits may be some specific adsorption of ions that may improve specific deposits, complexation, pH adjustment, solubility enhancement or reduction and the like. The invention also contemplates the addition of such acids, bases or salts into the electrolyte in amounts up to about 0.4 M.

A plating solution having a high copper concentration (i.e., >0.4M) is beneficial to overcome mass transport limitations that are encountered when plating small features. In particular, because micron scale features with high aspect ratios typically allow only minimal or no electrolyte flow therein, the ionic transport relies solely on diffusion to deposit metal into these small features. A high copper concentration, preferably about 0.85 molar (M) or greater, in the electrolyte enhances the diffusion process and reduces or eliminates the mass transport limitations. The metal concentration required for the plating process depends on factors such as temperature and the acid concentration of the electrolyte.

The plating solutions of the present invention are typically used at current densities ranging from about 10 mA/cm$^2$ to about 80 mA/cm$^2$. Current densities as high as 100 mA/cm$^2$ and as low as 5 mA/cm$^2$ can also be employed under appropriate conditions. In plating conditions where a pulsed current or periodic reverse current is used, current densities in the range of about 5 mA/cm$^2$ to about 400 mA/cm$^2$ can be used periodically.

The operating temperatures of the plating solutions may range from about 0° C. to about 95° C. Preferably, the solutions range in temperature from about 15° C. to about 60° C.

The plating solutions of the invention also preferably contain halide ions, such as chloride ions, bromide, fluoride, iodide, typically in amounts from 0 to about 0.2 g/L, preferably from about 10 ppm to about 100 ppm. However, this invention also contemplates the use of copper plating solutions without chloride or other halide ions.

The plating solutions of the invention are suppressed by the polyalkylene glycol "carriers". An example of a preferred carrier that is commercially available is UCON Lubricant 75-H-1400 polyalkylene glycol available from Union Carbide Corp. of Danbury, Conn. This carrier has a general formula of:

$$H(OCH_2CH_2)_x(OCH_2CH(CH_3))_yOH$$

wherein x and y provide an approximate weight average molecular weight of 2500. The specific gravity is 1.095 at 20° C.

Plating solutions containing polyalkylene glycols are accelerated by organic divalent sulfur compounds having the general formula R—S—S—R wherein R is an organic group. Commercially available organic divalent sulfur compounds include SPS which is the disodium salt of 3,3-dithiobis-1-propanesulfonic acid. The SPS is available from Raschig Corp. of Richmond, Va. The disodium salt comprises at least 80% of the SPS, and the remaining components include monosodium salts of 3-mercapto-1-propanesolfonic acid or 3-hydroxy-1-propanesulfonic acid. The commercial SPS may also contain the disodium salt of 3,3-thiobis-1-propanesulfonic acid.

In addition to the constituents described above, the plating solutions may contain various additives that are introduced typically in small ppm range) amounts. The additives typically improve the thickness distribution (levelers), the reflectivity of the plated film (brighteners), its grain size (grain refiners), stress (stress reducers), adhesion and wetting of the part by the plating solution (wetting agents), and other process and film properties.

The additional additives typically constitute small amounts (ppm level) from one or more of the following groups of chemicals:

1. Organic nitrogen compounds and their corresponding salts and polyelectrolyte derivatives thereof.
2. Polar heterocycles A preferred additive is 2-amino-5-methyl-1,3,4-thiadiazole hydrochloride which is used at concentrations from 0 ppm to about 20 ppm of the plating solution, preferably from about 0.5 ppm to about 5 ppm. The additive enhances the surface brightness of the deposited metal.

Further understanding of the present invention will be had with reference to the following examples which are set forth herein for purposes of illustration but not limitation.

EXAMPLE I

An electroplating bath consisting of 210 g/L of copper sulfate pentahydrate was prepared. A flat tab of metallized wafer was then plated in this solution at an average current density of 40 mA/cm$^2$ and without agitation. The resulting deposit was dull and pink.

EXAMPLE II

To the bath in example I was then added 50 mg/L of chloride ion in the form of HCl or $CuCl_2$. Another tab was then plated using the same conditions. The resulting deposit was shinier and showed slight grain refinement under microscopy.

EXAMPLE III

An electroplating bath consisting of 210 g/L of copper sulfate pentahydrate and 50 mg/L of chloride ion was prepared. To the bath was added the following:

| Compound | Approximate Amount (ppm) |
|---|---|
| UCON ® 75-H-1400(Polyalkylene glycol with an average molecular weight of 1400 commercially available from Union Carbide.) | 100 |
| SPS(organic divalent sulfur compound available from Raschig Corp.) | 5 |
| 2-amino-5-methyl-1,3,4-thiadiazole hydrochloride(Available from Aldrich.) | 0 |

A flat tab of metallized wafer was then plated in this solution at an average current density of 40 mA/cm$^2$ and without agitation. The resulting deposit was shinier than that in Comparison Example II. Microscopy revealed fine grains.

EXAMPLE IV

An electroplating bath consisting of 210 g/L of copper sulfate pentahydrate and 50 mg/L of chloride ions was prepared. To the bath was added the following:

| Compound | Approximate Amount (ppm) |
|---|---|
| UCON ® 75-H-1400(Polyalkylene glycol with an average molecular weight of 1400 commercially available from Union carbide) | 100 |
| SPS(organic divalent sulfur compound available from Raschig Corp.) | 5 |

-continued

| Compound | Approximate Amount (ppm) |
|---|---|
| 2-amino-5-methyl-1,3,4-thiadiazole hydrochloride(Available from Aldrich) | 5 |

A flat tab of metallized wafer was then plated in this solution at an average current density of 40 mA/cm$^2$ and without agitation. The resulting deposit was mirror like. Microscopy revealed extremely fine grains.

The present invention is defined by the following claims, and is not generally limited to specific embodiments described in the specification or examples. Other embodiments will be apparent to persons skilled in the art after reading this application.

What is claimed is:

1. A method for electrolytic plating of a metal on an electrically resistive substrate, comprising:

disposing an electrically resistive substrate and an anode in a plating solution, the plating solution comprising:

metal ions at a molar concentration from about 0.2 to about 1.2;

a polyalkylene glycol at a concentration from about 10 ppm to about 2000 ppm of plating solution;

from about 0.1 ppm to about 1000 ppm of a divalent sulfur compound; and about 0.5 to about 5 ppm of 2-amino-5-methyl-1,3,4-thiadiazole hydrochloride; and electrodepositing the metal onto the electrically resistive substrate from the metal ions in the solution.

2. The method of claim 1, wherein the plating solution comprises halide ions at a conentration from about 10 ppm to about 200 ppm.

3. The method of claim 2, wherein the plating solution comprises the divalent sulfur compound at a concentration from about 1 ppm to about 40 ppm.

4. The method of claim 3, wherein the divalent sulfur compound comprises the structure R—S—S—R, wherein R is an organic group.

5. The method of claim 1, wherein the metal comprises copper.

6. The method of claim 1, wherein the metal ions are copper ions.

7. The method of claim 6, wherein the copper ions are provided by a copper salt selected from the group of copper sulfate, copper fluoborate, copper gluconate, copper sulfamate, copper sulfonate, copper pyrophosphate, copper chloride, copper cyanide, and combinations thereof.

8. The method of claim 6, wherein the copper ion concentration is greater than about 0.8 molar.

9. The method of claim 1, wherein the polyalkylene glycol comprises the formula $H(OCH_2CH_2)_x(OCH_2CH(CH_3))_yOH$, wherein x and y provide an approximate weight average molecular weight of 2500, and wherein the polyalkylene glycol is provided at a concentration of from about 10 to about 100 ppm.

10. The method of claim 1, wherein electrodepositing the metal comprises applying a current density between about 5 mA/cm2 and about 400 mA/cm2 to the substrate.

11. A method for electrolytic plating of a metal on an electrically resistive substrate, comprising:

disposing an electrically resistive substrate and an anode in a plating solution, the plating solution consisting essentially of:

metal ions at a molar concentration from about 0.2 to about 1.2;

a polyalkylene glycol at a concentration from about 10 ppm to about 2000 ppm of plating solution; and from about 0.1 ppm to about 1000 ppm of a divalent sulfur compound; and electrodepositing the metal onto the electrically resistive substrate from the metal ions in the solution;

wherein the plating solution comprises up to about 20 ppm of 2-amino-5-methyl-1,3,4-thiadiazole hydrochloride.

12. The method of claim 11, wherein the divalent sulfur compound comprises a disodium salt of 3,3-dithiobis-1-propanesulfonic acid.

13. The method of claim 11, wherein the plating solution comprises halide ions at a concentration from about 10 ppm to about 100 ppm.

14. The method of claim 11, wherein the metal ions are copper ions provided by a copper salt selected from the group of copper sulfate, copper fluoborate, copper gluconate, copper sulfamate, copper sulfonate, copper pyrophosphate, copper chloride, copper cyanide, and combinations thereof.

15. The method of claim 14, wherein the copper ion concentration is greater than about 0.8 molar.

16. The method of claim 11, wherein the polyalkylene glycol comprises the formula $H(OCH_2CH_2)_x(OCH_2CH(CH_3))_yOH$, wherein x and y provide an approximate weight average molecular weight of 2500, and wherein the polyalkylene glycol is provided at a concentration of from about 10 to about 100 ppm.

17. The method of claim 11, wherein electrodepositing the metal comprises applying a current density between about 5 mA/cm2 and about 400 mA/cm2 to the substrate.

18. The method of claim 11, wherein the divalent sulfur compound comprises a structure R—S—S—R, wherein R is an organic group.

* * * * *

UNITED STATES PATENT AND TRADEMARK OFFICE

CERTIFICATE OF CORRECTION

PATENT NO. : 6,379,522 B1
DATED : April 30, 2002
INVENTOR(S) : Landau et al.

It is certified that error appears in the above-identified patent and that said Letters Patent is hereby corrected as shown below:

Column 2,
Line 44, please change “copper (I)” to -- copper (II) --.

Column 4,
Line 19, please change “adistribution” to -- distribution --.

Column 5,
Line 62, please change “ppm range)” to -- (ppm range) --.

Signed and Sealed this

Tenth Day of June, 2003

JAMES E. ROGAN
*Director of the United States Patent and Trademark Office*